US006109951A

United States Patent [19]

Huang

[11] Patent Number: 6,109,951

[45] Date of Patent: Aug. 29, 2000

[54] ELECTRICAL CONNECTING MEMBER FOR CHRISTMAS LAMP CORDS

[76] Inventor: Shun-Feng Huang, No. 13, Lane 84, Nei Hu Road, Hsin Chu City, Taiwan

[21] Appl. No.: 09/290,231

[22] Filed: Apr. 13, 1999

[51] Int. Cl.[7] ..... H01R 4/24

[52] U.S. Cl. ..... 439/419

[58] Field of Search ..... 439/419, 404, 439/405, 374, 680, 701

[56] References Cited

U.S. PATENT DOCUMENTS 5,643,006 7/1997 Wang et al. ..... 439/419

*Primary Examiner*—Paula Bradley
*Assistant Examiner*—Briggitte R. Hammond
*Attorney, Agent, or Firm*—Rosenberg, Klein & Lee

[57] ABSTRACT

A connecting member for Christmas lamp cords is provided for connecting two cords. Several connecting members of the kind can be used to connect cords for same to form a net-shape or a branch-like shape. The connecting member has a cover part coupled to a holding box part. A connecting part is received in the holding box part, and has two conducting chips connected to a first cord. A second cord is positioned between the covering part and the connecting part such that the covering part depress the second cord when same is coupled to said holding box part. The conducting chips penetrate the protective coverings of the second cord to connect the wires therein. Both the covering part and the connecting part have tapered protrusions fitted into between the protective coverings of the second cord for same to be located firmly, and is not possible to move to an improper position where the chips would connect a wrong wire.

2 Claims, 5 Drawing Sheets

ELECTRICAL CONNECTING MEMBER FOR CHRISTMAS LAMP CORDS

BACKGROUND OF THE INVENTION

The present invention relates to an electrical connecting member for connecting cords, and particularly to one for connecting cords of Christmas lamps such that the Christmas lamps cords can be connected to have a net-like shape or a branch-like shape, as shown in FIG. 4.

Referring to FIG. 5, a heretofore known connecting member 2 includes a holding box part 21, a connecting part 22 and a covering part 23. The connecting member 2 is used for connecting cords 1 and 1'.

The holding box part 21 has two gaps 211 on two sides, and two flanges 212 standing out from from upper edges thereof.

The connecting part 22 has two confining chambers 221 and two conducting chips 222,223 substantially held within a respective one of the chambers 221. The conducting chips 222, 223 are each connected to a respective one of wires of the cord 1 at lower portion thereof, and project out from the upper side of the connecting part 22.

The covering part 23 substantially has an inverted "U" shape, and has a projecting surface 232 and two inwardly extended edges 231.

In combination, referring to FIG. 6, the connecting part 22 is housed inside the holding box part 21, and the wires of the cord 1 are connected to a respective one of the conducting chips 222, 223. The cord 1' is positioned on the top of the connecting member 22, and confined by the gaps 211 of the holding box part 21. Then, the covering part 23 is connected to the holding box part 21 with the extended edges 231 engaging the flanges 212 of the holding box part 21. Thus, the projecting surface 232 depresses the cord 1' for protective coverings of the cord 1' to be penetrated by a respective one of the conducting chips 222 and 223. Consequently, the wires of the cord 1' are each electrically connected to a respective one of the chips 222 and 223. _p However, it is found that the connecting member 2 has disadvantages as follows.

1. The cord 1' is likely to be unwarily moved when the covering part is being connected to the holding box part 21, although the gaps 211 are provided for confining it. Consequently, the chips 222 or 223 cannot properly connect the wires, as shown in FIG. 7.

2. The cord 1' is also likely to be moved in a way that the chips 222 and 223 connect wrong wires of the cord 1' causing the whole Christmas lamps to short-circuit.

SUMMARY

It is a main object of the present invention to provide a connecting member for Christmas lamp cords firmly connected thereto. Thus, the cords are not possible to be electrically connected to wrong conductors of the connecting member, and the failure products can be greatly reduced.

The connecting member for Christmas lamp cords comprises a holding box part, a connecting part and a covering part. The connecting part has two conducting chips. Each of the conducting chips connects to a respective one of two wires of a first cord. The connecting part is received within the holding box part and has an elongated tapered protrusion received in a tapered recess on inner side of the holding box part. The connection of the tapered protrusion to the tapered recess makes the connecting part firmly located in the holding box part.

A second cord is positioned on top of the connecting part, and confined by gaps on upper edge of the holding box part. The covering part is connected to upper end portion of the holding box part with a central tapered protrusion being inserted between two protective coverings of the second cord. The second cord is also depressed by the covering part such that the protective coverings of the second cord are each penetrated by a respective one of the conducting chips. Thus, the wires of the second cord are electrically connected to the wires of the first cord.

Besides the tapered protrusion of the covering part, the tapered protrusion of the connecting part is also fitted into between the two protective coverings of the second cord from bottom side of the cord. So, the second cord is not possible to move to an improper position where the wires thereof would be connected to a wrong one of tile conducting chips.

BRIEF DESCRIPTION OF THE DRAWINGS

The present invention will be better understood with reference to the accompanying drawings, wherein.

DETAILED DESCRIPTION OF THE PREFERRED EMBODIMENTS

Figure 1:
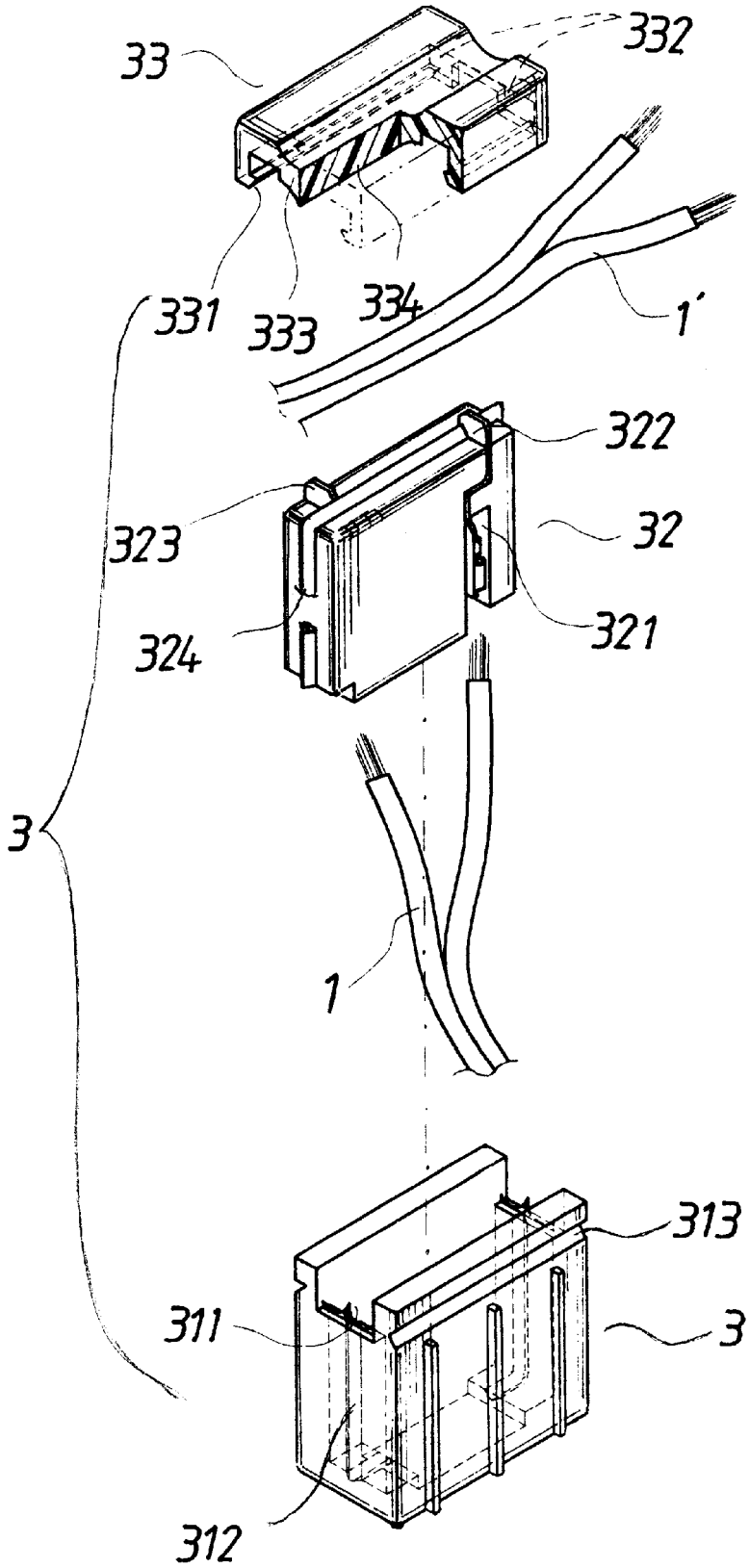
FIG. 1 is an exploded perspective view of a connecting member for Christmas lamp cords of the present invention.
Figure 6:
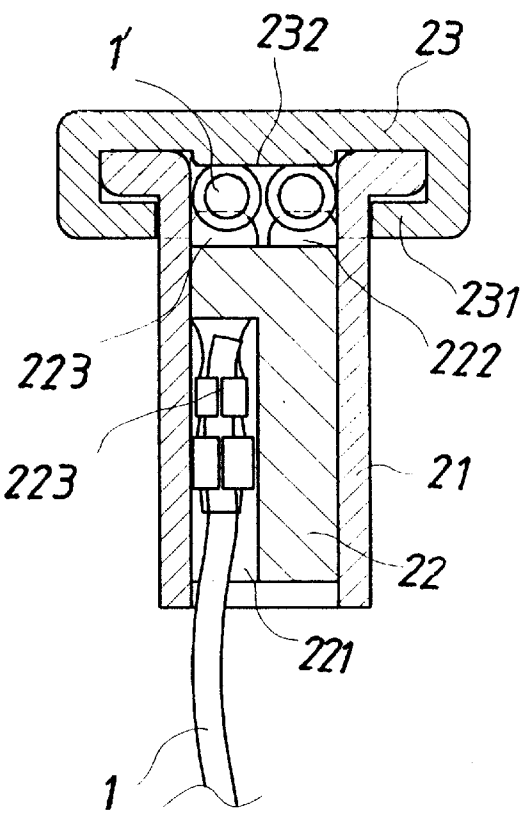
FIG. 6 (PRIOR ART)
FIG. 6 is a cross-sectional view the connecting member for Christmas lamp cords in FIG. 5.
Figure 4:
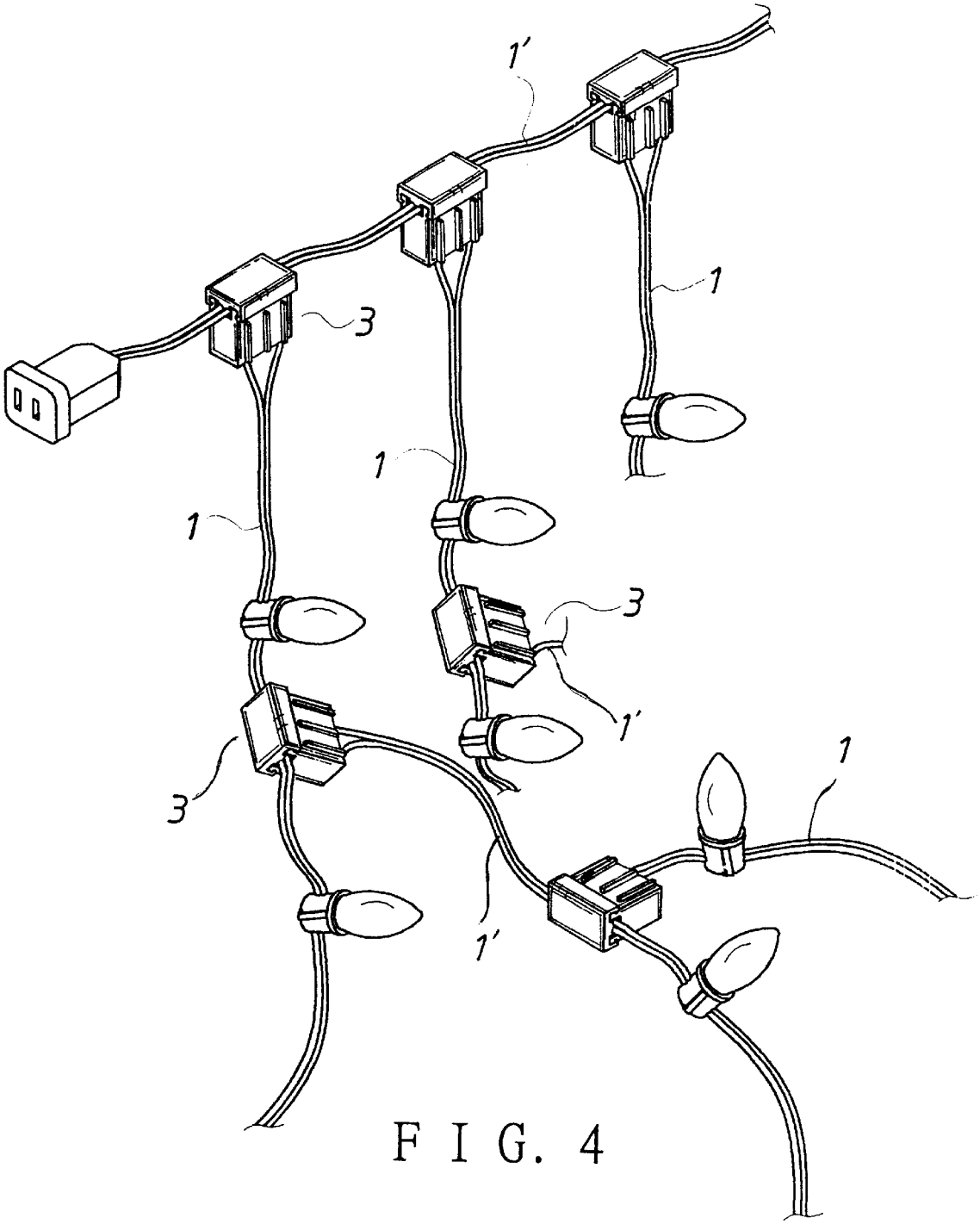
FIG. 4 is a fragmentary view of a Christmas lamps set with the connecting members of the present invention.
Figure 5:
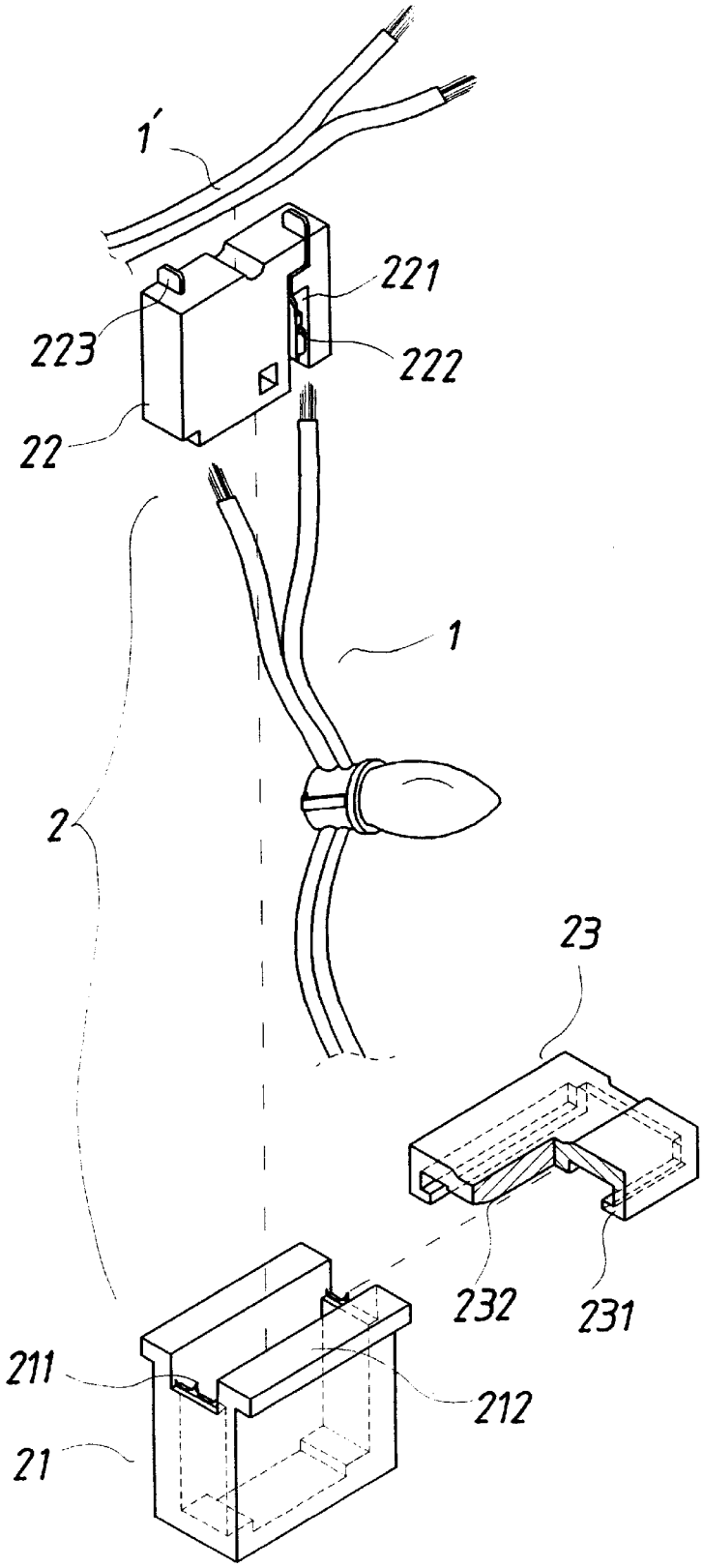
F I G. 5(PRIOR ART)
FIG. 5 is an exploded perspective view of a conventional connecting member for Christmas lamp cords.
Figure 7:
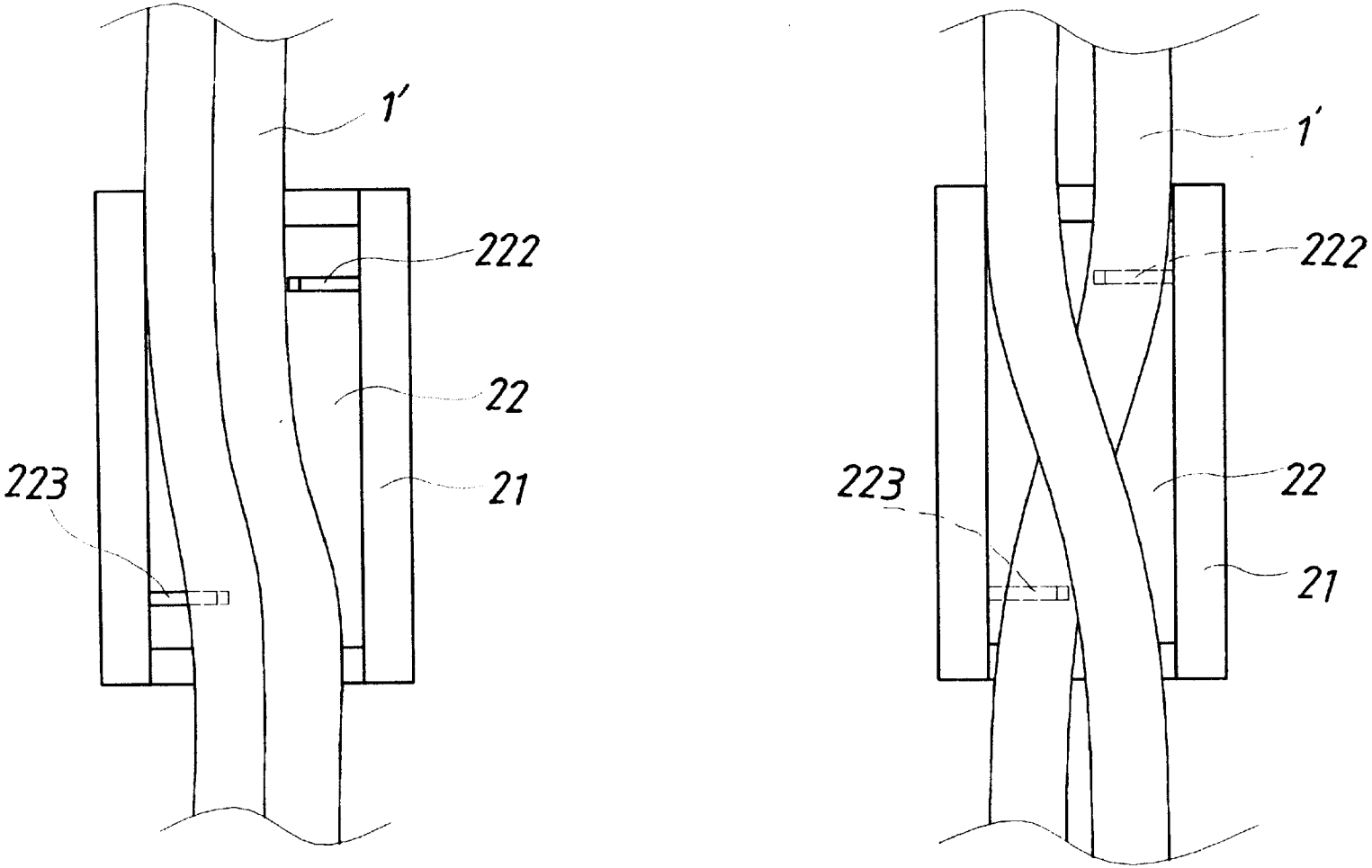
FIG. 7 (PRIOR ART)
FIG. 7 is a view showing the conventional connecting member and the cord associated therewith that go wrong.

Referring to FIG. 1, a connecting member 3 for Christmas lamp cords of the present invention includes a holding box part 31, a connecting part 32 and a covering part 33. The connecting member 3 is provided for connecting cords 1 and 1'. With the connecting member 3, several cords can be connected to have a net-like shape or a branch-like one as shown in FIG. 4.

The holding box part 31 is provided for housing the connecting part 32 therein, and has two gaps 311 and two engaging trenches 313 on outer sides thereof.

The connecting part 32 has two conducting chips 322, 323. Each of them connects to a respective wire of the cord 1. Like those of the conventional connecting member for Christmas lamp cords, the conducting chips 322,323 of the present invention project out from top of the connecting part 32. The connecting part 32 further has a tapered protrusion 324 thereon, having substantially an inverted "U" shape.

The holding box part 31 further has two tapered locating recesses such that the tapered protrusion 324 of the connecting part 32 can be firmly received in the tapered locating recesses 312 to locate the connecting part 32 when it is inserted into the holding box part 31.

The covering part 33 has two extended engaging edges 331, a central projecting surface 333, two stopping walls 332 on one side and a tapered protrusion 334 on the projecting surface 333.

Figure 2:
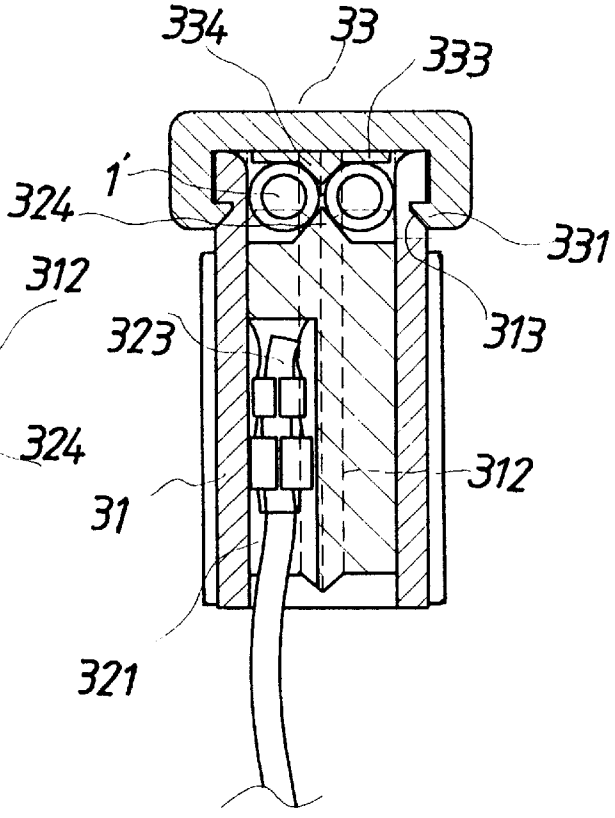
FIG. 2 is a cross-sectional view of the connecting member for Christmas lamp cords in FIG. 1.
Figure 3:
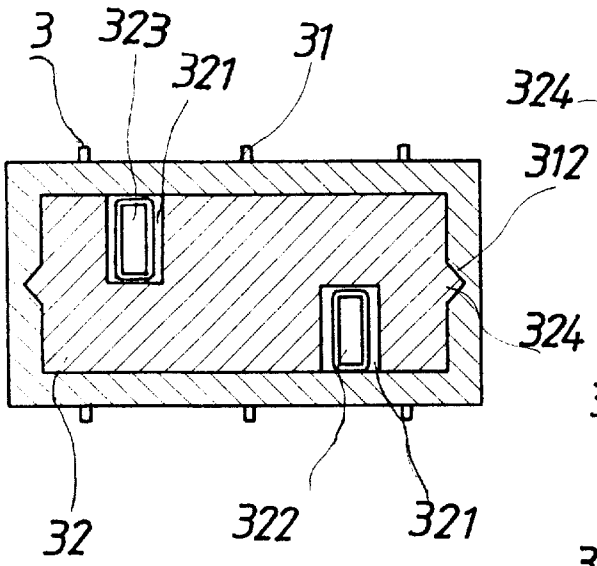
FIG. 3 is a top view of the connecting member for Christmas lamp cords in FIG. 1.

In combination, referring to FIG. 2, the connecting part 32 is inserted into the holding box part 31 and connected to the wires of the cord 1 with the tapered protrusion 324 received in the locating recesses 312. Then, the cord 1' is positioned on top of the connecting part 32, and confined by the gaps 311 of the holding box part 31. The covering part 33 is connected to the holding box part 31 with the extended engaging edges 331 engaging a respective one of the engaging trenches 313 of the holding box part 31. The stopping walls 332 help the covering part 33 to be located in a proper position. The tapered protrusions 324 and 334 locate the cord 1' at a central position. Thus, the projecting surface 333 depresses the cord 1 for protective coverings of the cord 1' to be penetrated by the conducting chips 322, 323 such that the wires of the cord 1' are electrically connected to the wires of the cord 1.

From the above description, it can be understood the connecting member for Christmas lamp cords of the present invention overcomes the disadvantages of the conventional one described in the Background. For example, the cord 1' can be located in a proper position without possibility of moving aside by means of the tapered protrusions 324 and 334. Consequently, the failure products are greatly decreased.

What is claimed is:

1. A connecting member for connecting Christmas lamp cords into a net-like structure, comprising:

(a) a holding box including a pair of opposite first walls and a pair of opposite second walls connected with said first walls to form an interior space therebetween, each of said first walls having a tapered locating recess formed in an internal surface thereof and extending substantially from a top edge to a bottom edge of said first wall;

(b) a connecting part removably received within said interior space of said holding box and including:

(i) a connecting part body having a top surface and a pair of side surfaces at opposing ends of said top surface, (ii) a first tapered protrusion having a portion extending longitudinally along said top surface and portions extending along said pair of side surfaces of said connecting part body, each of said portions of said first tapered protrusion extending over a respective one of said side surfaces being engaged within a corresponding one of said tapered locating recesses of said first walls of said holding box, (iii) a pair of cord receiving recesses formed within said connecting part body, and (iv) a pair of conducting chips, each secured within a respective one of said cord receiving recesses, each said conducting chip having an outer part exposed on said top surface of said connecting part body;

(c) a covering part adapted for sliding engagement with said holding box, said covering part including:

(i) a top portion and a pair of walls extending along side edges of said top portion, and (ii) a second tapered protrusion extending longitudinally along an internal surface of said top portion of said covering part in substantial alignment with said portion of said first tapered protrusion extending along said top surface of said connecting part body;

(d) a first cord including a pair of electrically insulated first wires, each of said first wires being received within a respective one of said cord receiving recesses of said connecting part body and being electrically coupled to a respective conducting chip; and (e) a second cord including a pair of electrically insulated second wires, each of said second wires extending in a respective channel defined between said top surface of said connecting part body and said internal surface of said top portion of said covering part by said first and second tapered protrusions, said outer part of each of said conducting chips respectively penetrating through electrical insulation of said second wires to thereby electrically couple said first and second cords.

2. The connecting member for connecting Christmas lamp cords as claimed in claim 1, wherein said covering part further includes engaging edges internally projected from said side edges of said top portion of said covering part, and wherein said holding box further includes engaging trenches, each extending at the top edge of each of said second walls thereof, each of said engaging edges engaging a respective one of said engaging trenches of said holding box.

* * * * *